US009687062B2

(12) United States Patent
Scicluna

(10) Patent No.: US 9,687,062 B2
(45) Date of Patent: Jun. 27, 2017

(54) CHECKPOINT-FRIENDLY BACKPACK

(75) Inventor: Paul V. Scicluna, Penndel, PA (US)

(73) Assignee: TUMI, INC., South Plainfield, NJ (US)

( * ) Notice: Subject to any disclaimer, the term of this patent is extended or adjusted under 35 U.S.C. 154(b) by 271 days.

(21) Appl. No.: 12/387,692

(22) Filed: May 6, 2009

(65) Prior Publication Data

US 2010/0282809 A1 Nov. 11, 2010

(51) Int. Cl.
*A45F 3/04* (2006.01)
*A45C 7/00* (2006.01)
(Continued)

(52) U.S. Cl.
CPC ..... *A45F 3/04* (2013.01); *A45C 7/0095* (2013.01); *A45C 13/02* (2013.01); *A45C 2011/003* (2013.01); *A45C 2013/025* (2013.01)

(58) Field of Classification Search
CPC ... A45C 7/0027; A45C 5/14; A45C 2013/025; A45C 2003/005; A45C 2011/003;
(Continued)

(56) References Cited

U.S. PATENT DOCUMENTS 4,901,897 A * 2/1990 Briggs et al. ..... 224/153
5,544,792 A 8/1996 Arnwine
(Continued)

FOREIGN PATENT DOCUMENTS

CA 2518127 A1 * 3/2007 ..... 224/657
FR 2760333 A1 9/1998

OTHER PUBLICATIONS

"Checkpoint Friendly Laptop Bag Prcedures", Transportation Security Administration Aug. 15, 2008 (Aug. 15, 2008), XP002682908, Retrieved from the Internet: URL: http://www.tsa.gov/press/happenings/simplifying_laptop_bag_procedures.shtm. [retrieved on Sep. 4, 2012]. 3 pages.
(Continued)

*Primary Examiner* — Nathan J Newhouse
*Assistant Examiner* — Matthew Theis
(74) *Attorney, Agent, or Firm* — Lando & Anastasi, LLP

(57) ABSTRACT

A checkpoint-friendly backpack for allowing a laptop computer stored in a dedicated portion thereof to provide a clear, unobstructed, and distinct image thereof when X-ray screened at an inspection station without having to remove the laptop computer from the dedicated portion. The backpack includes a dedicated compartment and a non-dedicated compartment. The non-dedicated compartment stores items other than the laptop computer. The dedicated compartment stores only the laptop computer itself, is hingedly attached to the non-dedicated compartment at a common edge, is free of metallic snaps, zippers, and buckles, is free of pockets, and has a non-screening mode where it is replaceably fastened in side-by-side relationship to the non-dedicated compartment by a non-metallic zipper so as to facilitate unfastening the dedicated compartment from the non-dedicated compartment, and a screening mode where it is unfastened from the non-dedicated compartment and unfolded therefrom to lie unobstructed, flat, and substantially coplanar with the non-dedicated compartment on the inspection station so as to allow the laptop computer stored in the dedicated compartment to provide the clear, unobstructed, and distinct image thereof when X-ray screened at the inspection station without having to remove the laptop computer from the dedicated compartment.

28 Claims, 6 Drawing Sheets

(51) Int. Cl.
*A45C 13/02* (2006.01)
*A45C 11/00* (2006.01)

(58) Field of Classification Search
CPC ... A45C 7/0086; A45C 7/0095; A45C 7/0077; A45C 3/02; A45C 7/0045; A45C 2013/306; A45C 7/0054; A45C 13/02
USPC ..... 224/653, 657, 153, 190, 654, 645, 627, 224/600, 676, 637; 190/109, 110, 111, 190/100, 106, 115; 206/320
See application file for complete search history.

(56) References Cited

U.S. PATENT DOCUMENTS

| | | | | |
|---|---|---|---|---|
| 5,706,992 | A | 1/1998 | Moor | |
| 5,938,096 | A * | 8/1999 | Sauer | A47B 23/002 190/109 |
| 6,015,072 | A | 1/2000 | Young | |
| 6,213,267 | B1 * | 4/2001 | Miller | 190/108 |
| 6,305,587 | B1 | 10/2001 | Miller | |
| 6,796,473 | B2 | 9/2004 | Purpura | |
| 6,932,256 | B2 | 8/2005 | Hale | |
| 7,975,816 | B1 * | 7/2011 | Lin | 190/37 |
| 2005/0072644 | A1 * | 4/2005 | Gormick et al. | 190/111 |
| 2005/0189188 | A1 | 9/2005 | Barnes | |
| 2005/0194413 | A1 * | 9/2005 | Baker | 224/153 |
| 2007/0137959 | A1 * | 6/2007 | Zauderer | 190/110 |
| 2009/0223845 | A1 * | 9/2009 | Bosma et al. | 206/320 |
| 2009/0314594 | A1 * | 12/2009 | Harrison et al. | 190/109 |

OTHER PUBLICATIONS

"Mobile Edge-16 ScanFast Backpack", Buy.com Inc., Jan. 15, 2008 (Jan. 15, 2008), XP002682907, Retrieved from the Internet: URL:http:www.buy.com/prod/mobile-edge-16-scanfast-backpack/ 208898225.html. [retrieved on Sep. 4, 2012]. 3 pages.

Targus Zip-Thru Air Traveler BAckpack Buy.com Inc., Mar. 12, 2009 (Mar. 12, 2009), XP002682906, Mar. 12, 2009 (Mar. 12, 2009), XP002682906, Retrieved from the Internet: URL:http:// www.buy.com/prod/targus-zip-thru-air-travelr-backpack/ 210594250. html [retrieved on Sep. 4, 2012]. 4 pages.

* cited by examiner

CHECKPOINT-FRIENDLY BACKPACK

THE BACKGROUND OF THE INVENTION

A. The Field of the Invention

The embodiments of the present invention relate to a backpack for a laptop computer, and more particularly, the embodiments of the present invention relate to a checkpoint-friendly backpack for allowing a laptop computer stored in a dedicated portion thereof to provide a clear, unobstructed, and distinct image thereof when X-ray screened at an inspection station without having to remove the laptop computer from the dedicated portion.

B. The Description of the Prior Art

Since 9/11, the world of public transportation has changed significantly. In fact, there is now a government agency—the Transportation Security Agency ("TSA")—that is responsible for the heightened security at airports and other facilities. The security measures taken by TSA personnel to check each passenger and all packages carried on-board airplanes has resulted in long lines and increased pre-flight boarding times.

While TSA personnel use sophisticated instruments to determine the presence of illegal compounds and objects, there remains a requirement for visual inspection of certain devices. Packages, boxes, and carry-on bags must be opened for these visual inspections, with the opening and closing of these articles adding to the delays of clearing security points.

The laptop computer has become a normal accessory for many travelers, both for work and entertainment during a trip. The conventional laptop computer has no integrated carrying devices, and therefore, usually is placed in a carry case. Most cases have various pockets and compartments to carry peripheral equipment and other things the owner may include with the laptop computer. The carrying cases may be made of soft or hard materials, which may be padded, and which completely enclose the laptop computer for protection.

To help streamline the security process and better protect laptops, the TSA now allows passengers to leave their laptop computers in backpacks that meet the "checkpoint friendly" standards. For a backpack to be considered "checkpoint friendly," it must meet the following standards:

- Have a designated laptop-only section;
- Allow the laptop-only section to completely unfold to lie flat on the X-ray belt;
- Have no metal snaps, zippers, or buckles inside, underneath, or on top of the laptop-only section;
- Have no pockets on the inside or outside of the laptop-only section; and
- Have nothing packed in the laptop-only section other than the laptop computer itself.

Thus, there exists a need for a laptop backpack to be checkpoint friendly by having a designated laptop-only section, by allowing the laptop-only section to completely unfold to lie flat on the X-ray belt, by having no metal snaps, zippers, or buckles inside, underneath, or on top of the laptop-only section, by having no pockets on the inside or outside of the laptop-only section, and by having nothing packed in the laptop-only section other than the laptop computer itself.

Numerous innovations for laptop backpacks have been provided in the prior art, which will be described below in chronological order to show advancement in the art, and which are incorporated herein by reference thereto. Even though these innovations may be suitable for the individual purposes that they address, nevertheless, they differ from the embodiments of the present invention in that they do not teach a checkpoint-friendly backpack for allowing a laptop computer stored in a dedicated portion thereof to provide a clear, unobstructed, and distinct image thereof when X-ray screened at an inspection station without having to remove the laptop computer from the dedicated portion.

(1) U.S. Pat. No. 5,544,792 to Arnwine.

U.S. Pat. No. 5,544,792 issued to Arnwine on Aug. 13, 1996 in U.S. class 224 and subclass 153 teaches a book bag having a primary compartment and a plurality of substantially identical secondary compartments that are designed to function independently of each other while in a unitary arraignment. The compartments can be converted to a fully open relationship that allows for easy storage into narrow upright lockers. Each compartment has inner and outer parallel side panels connected by a bottom, a top, and two ends. The compartments are interconnected in a side-by-side relationship to the side panel of a mating compartment by zipper elements. Secured to the inner panel of each compartment is a shoulder harness to allow the book bag to be carried in a typical fashion on one's back. Individual compartments may also be carried by a handle secured to the top. Centrally positioned on the outer side panel is an expandable envelope designed for easy retrial of homework assignments or the like. Pockets are also provided on the ends of a compartment for storage of pens, rulers, pencils, or other school supplies. Near the outer side panel along the ends and top extends a U-shaped closure apparatus that when opened allows for entry within each compartment.

(2) U.S. Pat. No. 5,706,992 to Moor.

U.S. Pat. No. 5,706,992 issued to Moor on Jan. 13, 1998 in U.S. class 224 and subclass 657 teaches a backpack for carrying a laptop computer, which includes: flexible front, rear, bottom, and side panels, the interior surfaces of which define the interior of the backpack, and the side panel extends along each side and across the top of the backpack, and the front, rear, and side panels are joined together along their perimeters; a compartment for storing a laptop computer in the interior of the backpack; a first closure apparatus extending longitudinally along the side panel and transversely across the top to control access to the compartment; at least one adjustable interlocking assembly joined to the backpack so as to bridge the first closure at the bottom half of the backpack, whereby pivotal separation of the first closure along the side and the top panels is restricted to a predetermined interval when the closure apparatus is opened; and a pair of adjustable shoulder straps connected to the exterior of the rear panel for carrying the backpack.

(3) U.S. Pat. No. 6,015,072 to Young.

U.S. Pat. No. 6,015,072 issued to Young on Jan. 18, 2000 in U.S. class 224 and subclass 153 teaches a combination collapsible backpack and lined compartment that includes a backpack formed of a back section, a front section, and a bottom section attached-to the front section and the back section. The backpack further includes a pair of shoulder straps attached to the back section. The backpack may be collapsed onto the bottom section of the backpack. An upper lid is attached to the backpack. The lid attachment attaches the bottom section of the backpack and the upper lid when the backpack is collapsed onto the bottom section of the backpack, so that the collapsed backpack is between the bottom section of the backpack and the lid. A carrying compartment has side walls and a bottom wall. A compartment attachment attaches the side walls of the carrying compartment to the bottom section of the backpack, so that the bottom section of the backpack forms a top section of the carrying compartment. A liner having side walls and a bottom wall that substantially correspond with the side walls and bottom section of the carrying compartment is removably placed in the carrying compartment. A liner attachment detachably attaches the side walls of the liner with the side walls of the first compartment.

(4) U.S. Pat. No. 6,305,587 B1 to Miller.

U.S. Pat. No. 6,305,587 B1 issued to Miller on Oct. 23, 2001 in US class 224 and subclass 153 teaches a computer tote that is convertible from a hand-carried attache case to a shoulder-carried backpack. As an attache case, the computer tote may be carried by retractable handles. A convertible compartment houses a shoulder harness and a backpack compartment in a small, compact manner. The convertible compartment can be opened, so that the harness and backpack compartment can be unfolded. The backpack compartment expands the size of the case so as to allow additional items to be carried therein. The shoulder harness facilitates carrying the expanded tote on a user's back. The computer case has numerous other interior and exterior zippered compartments including a computer compartment. The computer compartment is sized for securely containing a portable computer, and is lined with a padded board for protecting the computer.

(5) U.S. Pat. No. 6,796,473 B2 to Purpura.

U.S. Pat. No. 6,796,473 B2 issued to Purpura on Sep. 28, 2004 in U.S. class 224 and subclass 576 teaches a laptop computer transport and support system for a mobile environment, such as an airplane, a bus, or a train, is embodied as a wheeled clamshell style backpack carrying case with a retractable handle. The system is employed by unzipping three case edges and lifting a hinged protective cover thereby exposing a computer. The backpack straps unhook from the cover and secure to a user's seatback or around a user's headrest, while strap posts at an opposite backpack strap end extend from the case and prevent strap interference with the user. A foldable or detachable handle permits retractable handle posts to extend on each side of the user and support the system against the seatback, instead of the user when the system is used. Optionally, computer peripherals within a compartmentalized base are connected within the base to a docking station port and provide the computer with quick access to the peripherals.

(6) U.S. Pat. No. 6,932,256 B2 to Hale et al.

U.S. Pat. No. 6,932,256 B2 issued to Hale et al. on Aug. 23, 2005 in U.S. class 224 and subclass 637 teaches a pack for carrying school books and other items, with the weight substantially balanced between the front and back of a wearer. A yoke has front and back pouches and an opening for the wearer's head. The sides of the front and back portions of the yoke are releasably connected by flaps at the sides of the back portion, which engage a strip of hook-and-loop material on the front pouch. An auxiliary bag is detachably connected to the back pouch.

(7) United States Patent Application Publication Number US 2005/0189188 A1 to Barnes.

United States Patent Application Publication Number US 2005/0189188 A1 published to Barnes on Sep. 1, 2005 in U.S. class 190 and subclass 110 teaches a protective case for carrying a portable laptop computer within a larger bag. The case includes a padded sleeve that slides within a rigid pocket that is removably attached to the inside of the larger bag. It further provides a modular system of interchangeable bags, padded sleeves, and rigid pockets.

It is apparent that numerous innovations for laptop backpacks have been provided in the prior art, which are adapted to be used. Furthermore, even though these innovations may be suitable for the individual purposes to which they address, nevertheless, they would not be suitable for the purposes of the embodiments of the present invention as heretofore described, namely, a checkpoint-friendly backpack for allowing a laptop computer stored in a dedicated portion thereof to provide a clear, unobstructed, and distinct image thereof when X-ray screened at an inspection station without having to remove the laptop computer from the dedicated portion.

THE SUMMARY OF THE INVENTION

Thus, an object of the embodiments of the present invention is to provide a checkpoint-friendly backpack for allowing a laptop computer stored in a dedicated portion thereof to provide a clear, unobstructed, and distinct image thereof when X-ray screened at an inspection station without having to remove the laptop computer from the dedicated portion, which avoids the disadvantages of the prior art.

Briefly stated, another object of the embodiments of the present invention is to provide a checkpoint-friendly backpack for allowing a laptop computer stored in a dedicated portion thereof to provide a clear, unobstructed, and distinct image thereof when X-ray screened at an inspection station without having to remove the laptop computer from the dedicated portion. The backpack includes a dedicated compartment and a non-dedicated compartment. The non-dedicated compartment stores items other than the laptop computer. The dedicated compartment stores only the laptop computer itself, is hingedly attached to the non-dedicated compartment at a common edge, is free of metallic snaps, metallic zippers, and metallic buckles, is free of pockets, and has a non-screening mode where it is replaceably fastened in side-by-side relationship to the non-dedicated compartment by a non-metallic zipper so as to facilitate unfastening the dedicated compartment from the non-dedicated compartment, and a screening mode where it is unfastened from the non-dedicated compartment and unfolded therefrom to lie unobstructed, flat, and substantially coplanar with the non-dedicated compartment on the inspection station so as to allow the laptop computer stored in the dedicated compartment to provide the clear, unobstructed, and distinct image thereof when X-ray screened at the inspection station without having to remove the laptop computer from the dedicated compartment.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

THE BRIEF DESCRIPTION OF THE DRAWING

The figures of the drawing are briefly described as follows.

THE LIST OF REFERENCE NUMERALS UTILIZED IN THE DRAWING

Figure 1:
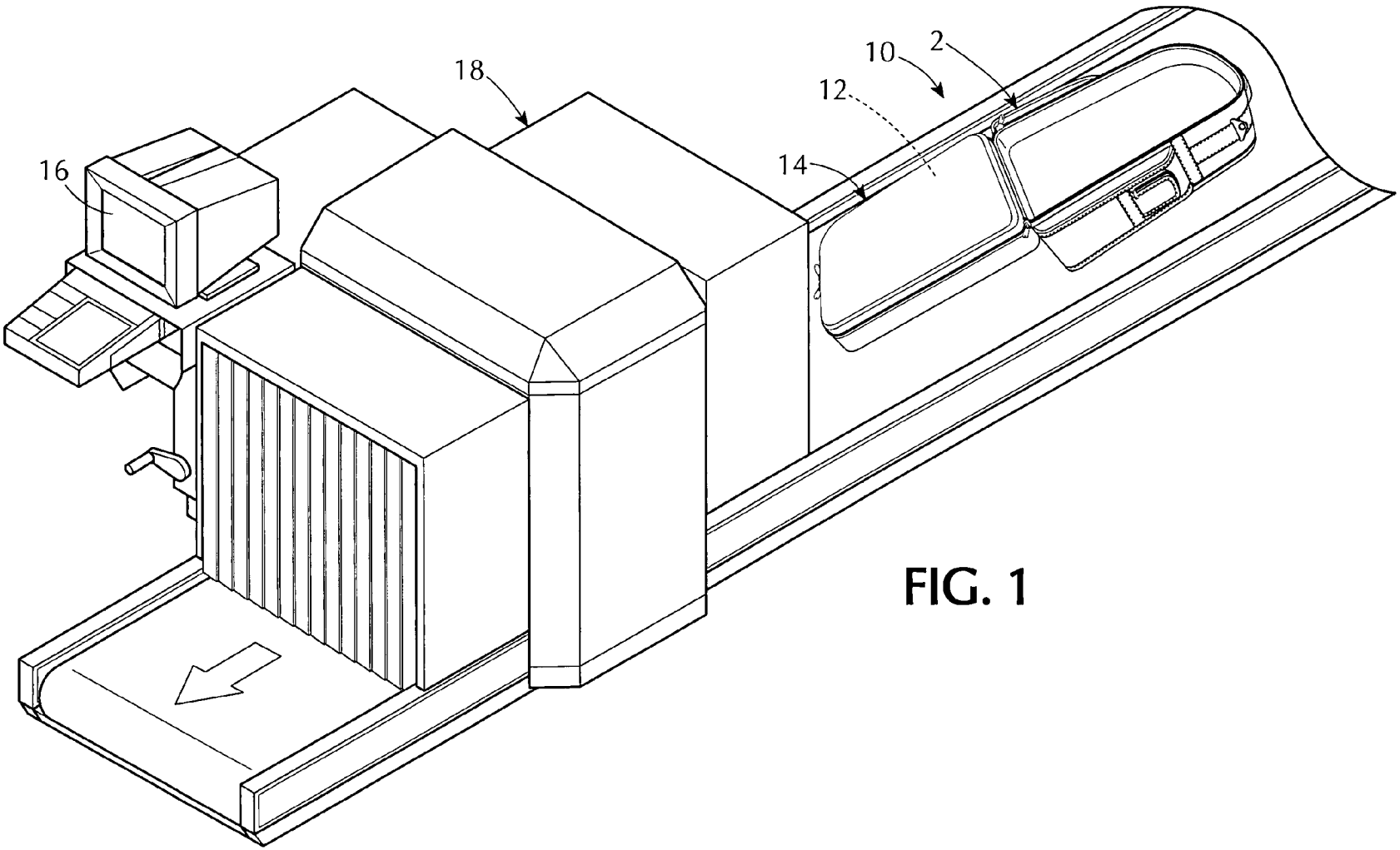
FIG. 1 is a diagrammatic perspective view of the checkpoint-friendly backpack of the embodiments of the present invention allowing a laptop computer stored in a dedicated portion thereof to provide a clear, unobstructed, and distinct image thereof when X-ray screened at an inspection station without having to remove the laptop computer from the dedicated portion.
Figure 2:
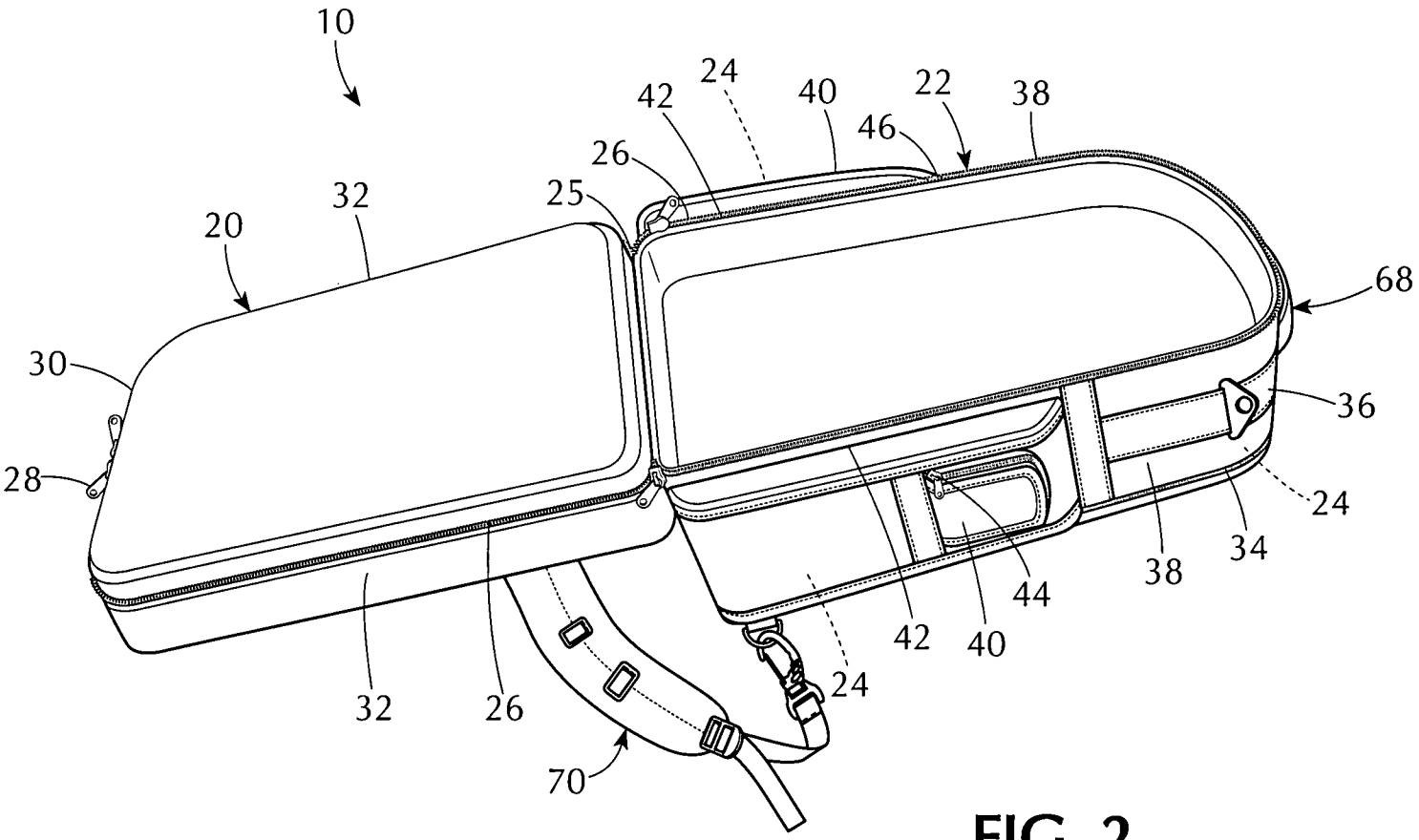
FIG. 2 is an enlarged diagrammatic perspective view of the checkpoint-friendly backpack in the X-ray screening mode identified by ARROW 2 in FIG. 1.

A. General.

10 checkpoint-friendly backpack of embodiments of present invention for allowing laptop computer 12 stored in dedicated portion 14 thereof to provide clear, unobstructed, and distinct image 16 thereof when X-ray screened at inspection station 18 without having to remove laptop computer 12 from dedicated portion 14

12 laptop computer

14 dedicated portion

16 clear, unobstructed, and distinct image

18 inspection station

B. Configuration of Checkpoint-Friendly Backpack 10.

20 dedicated compartment

22 non-dedicated compartment

24 items other than laptop computer 12

25 common edge

26 first non-metallic zipper

28 second non-metallic zipper

30 top wall of dedicated compartment 20

32 pair of side walls of dedicated compartment 20

34 third non-metallic zipper

36 top wall of non-dedicated compartment 22

38 pair of side walls of non-dedicated compartment 22

40 pair of first expandable side pockets

42 lower portions of pair of side walls 38 of non-dedicated compartment 22, respectively

44 fourth non-metallic zipper

46 fifth non-metallic zipper

48 outer wall of non-dedicated compartment 22

50 second expandable pocket

52 upper portion of outer wall 48 of non-dedicated compartment 22

54 third expandable pocket

56 intermediate portion of outer wall 48 of non-dedicated compartment 22

58 fourth expandable pocket

60 lower portion of outer wall 48 of non-dedicated compartment 22

62 sixth non-metallic zipper

64 seventh non-metallic zipper

66 eighth non-metallic zipper

68 handle

70 pair of shoulder strap of dedicated compartment 20

THE DETAILED DESCRIPTION OF THE PREFERRED EMBODIMENTS

A. General.

Referring now to the figures, in which like numerals indicate like parts, and particularly to FIG. 1, which is a diagrammatic perspective view of the checkpoint-friendly backpack of the embodiments of the present invention allowing a laptop computer stored in a dedicated portion thereof to provide a clear, unobstructed, and distinct image thereof when X-ray screened at an inspection station without having to remove the laptop computer from the dedicated portion, the checkpoint-friendly backpack of the embodiments of the present invention is shown generally at 10 for allowing a laptop computer 12 stored in a dedicated portion 14 thereof to provide a clear, unobstructed, and distinct image 16 thereof when X-ray screened at an inspection station 18 without having to remove the laptop computer 12 from the dedicated portion 14.

B. The configuration of the Checkpoint-Friendly Backpack 10.

Figure 3:
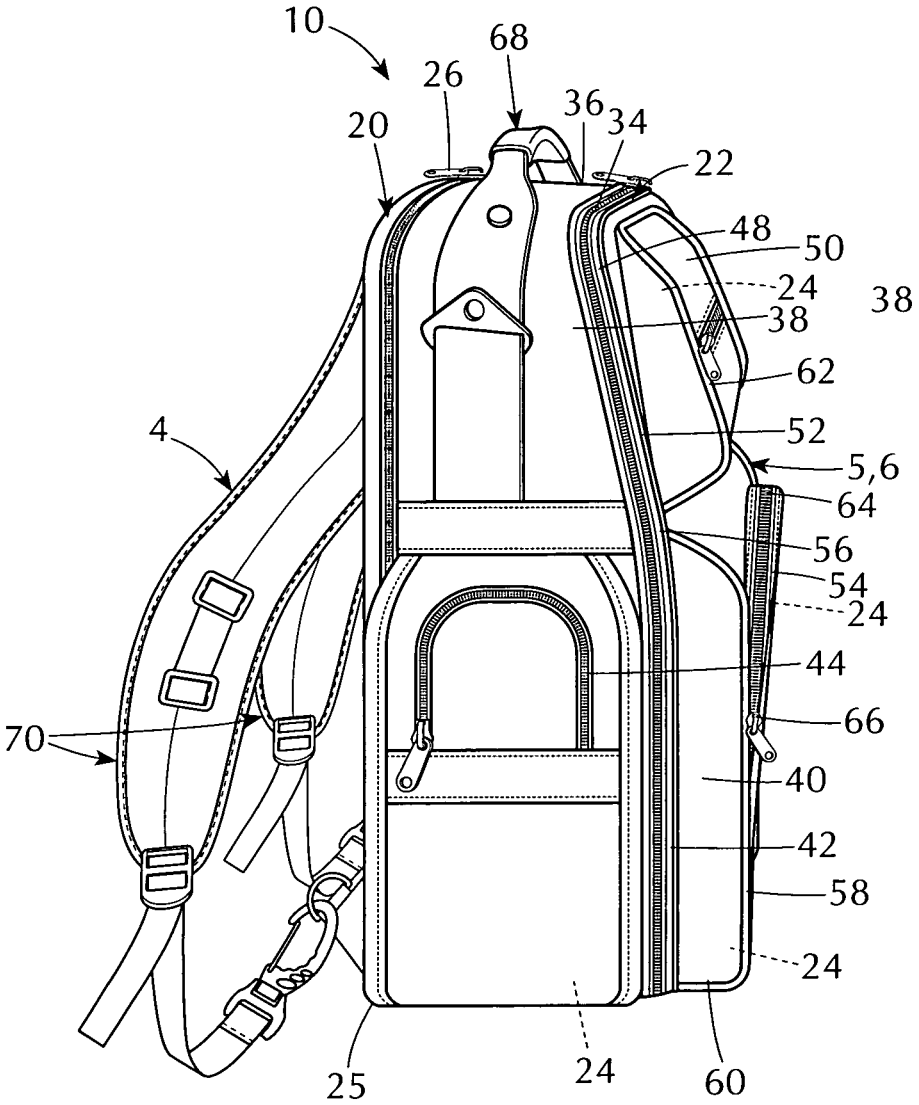
FIG. 3 is a diagrammatic perspective view of the checkpoint-friendly backpack in the non-X-ray screening mode.
Figure 4:
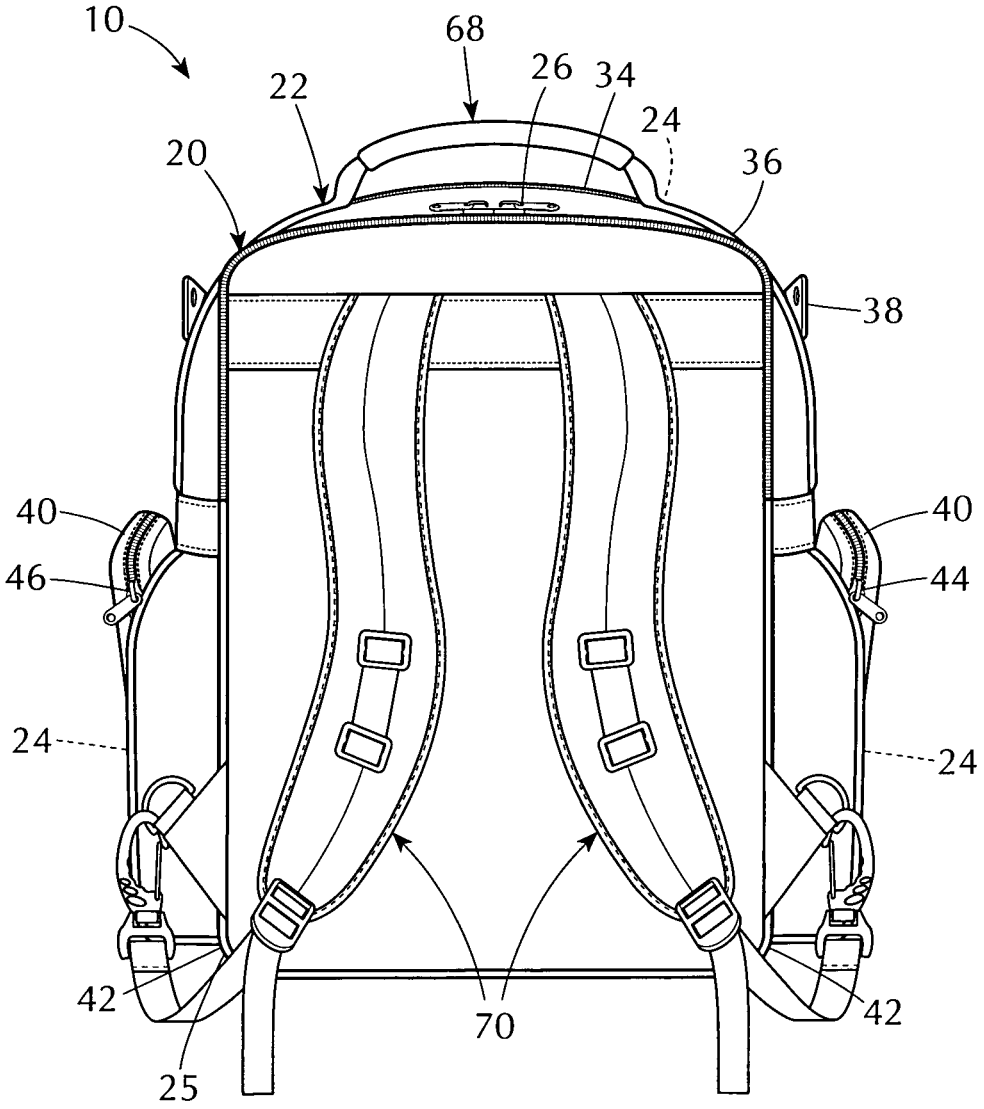
FIG. 4 is a diagrammatic rear elevational perspective view taken generally in the direction of ARROW 4 in FIG. 3.
Figure 5:
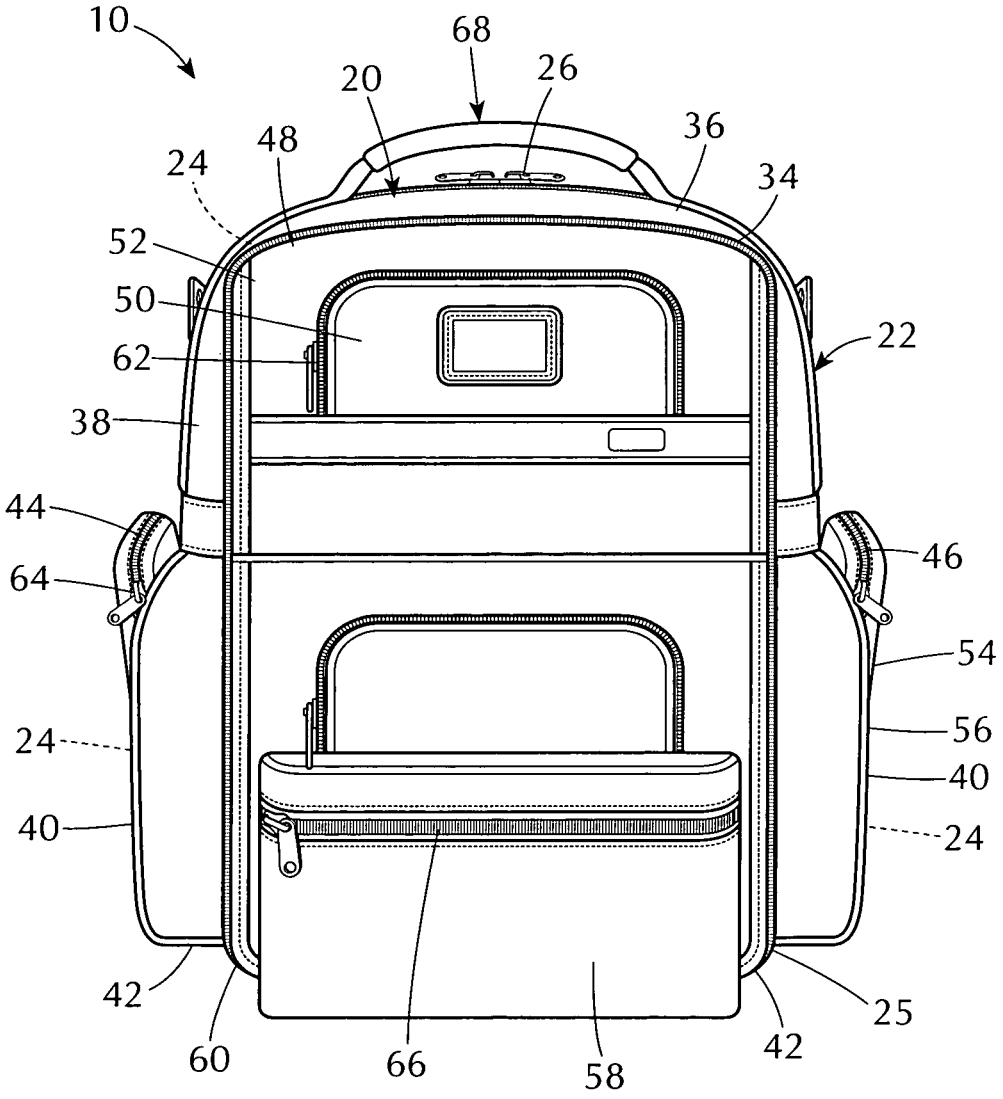
FIG. 5 is a diagrammatic front elevational perspective view taken generally in the direction of ARROW 5 in FIG. 3, with the non-dedicated compartment closed.
Figure 6:
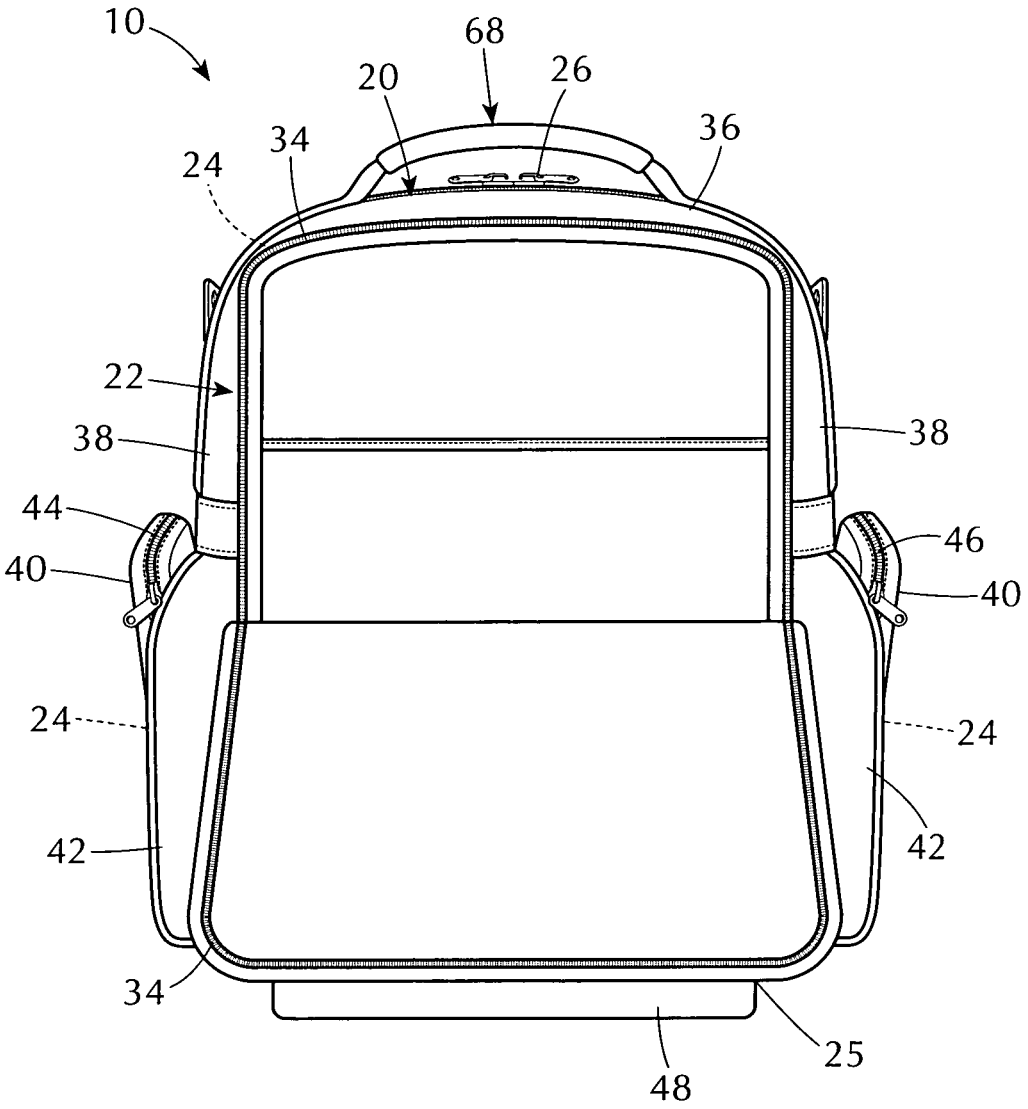
FIG. 6 is a diagrammatic front elevational perspective view taken generally in the direction of ARROW 6 in FIG. 3, with the non-dedicated compartment opened.

The configuration of the checkpoint-friendly backpack 10 can best be seen in FIGS. 2-6, which are, respectively, an enlarged diagrammatic perspective view of the checkpoint-friendly backpack in the X-ray screening mode identified by ARROW 2 in FIG. 1, a diagrammatic perspective view of the checkpoint-friendly backpack in the non-X-ray screening mode, a diagrammatic rear elevational perspective view taken generally in the direction of ARROW 4 in FIG. 3, a diagrammatic front elevational perspective view taken generally in the direction of ARROW 5 in FIG. 3, with the non-dedicated compartment closed, and a diagrammatic front elevational perspective view taken generally in the direction of ARROW 6 in FIG. 3, with the non-dedicated compartment opened, and as such, will be discussed with reference thereto.

The checkpoint-friendly backpack 10 comprises a dedicated compartment 20 and a non-dedicated compartment 22. The non-dedicated compartment 22 stores items 24 other than the laptop computer 12. The dedicated compartment 20 stores only the laptop computer 12 itself, is hingedly attached to the non-dedicated compartment 22 at a common edge 25, is free of metallic snaps, metallic zippers, and metallic buckles, is free of pockets, and has a non-screening mode where it is replaceably fastened in side-by-side relationship to the non-dedicated compartment 22 by a first non-metallic zipper 26 so as to facilitate unfastening the dedicated compartment 20 from the non-dedicated compartment 22, and a screening mode where it is unfastened from the non-dedicated compartment 22 and unfolded therefrom to lie unobstructed, flat, and substantially coplanar with the non-dedicated compartment 22 on the inspection station 18 so as to allow the laptop computer 12 stored in the dedicated compartment 20 to provide the clear, unobstructed, and distinct image 16 thereof when X-ray screened at the inspection station 18 without having to remove the laptop computer 12 from the dedicated compartment 20.

The dedicated compartment 20 is accessible for the laptop computer 12 via a second non-metallic zipper 28. The second non-metallic zipper 28 is disposed continuously on a top wall 30 and on a pair of side walls 32 of the dedicated compartment 20.

The non-dedicated compartment 22 is accessible for the items 24 other than the laptop computer 12 via a third non-metallic zipper 34. The third non-metallic zipper 34 is disposed continuously on a top wall 36 and a pair of side walls 38 of the non-dedicated compartment 22.

The non-dedicated compartment 22 further comprises a pair of first expandable side pockets 40. The pair of first expandable side pockets 40 are disposed on the side walls 38 of the non-dedicated compartment 22, at lower portions 42 thereof, respectively, for storing the items 24 other than the laptop computer 12.

The pair of first expandable side pockets 40 of the non-dedicated compartment 22 are accessible via a fourth non-metallic zipper 44 and a fifth non-metallic zipper 46, respectively.

An outer wall 48 of the non-dedicated compartment 22 harbors a second expandable pocket 50 on an upper portion 52 thereof, a third expandable pocket 54 on an intermediate portion 56 thereof, and a fourth expandable pocket 58 on a lower portion 60 thereof.

The second expandable pocket 50, the third expandable pocket 54, and the fourth expandable pocket 58 are accessible for the items 24 other than the laptop computer 12 via a sixth non-metallic zipper 62, a seventh non-metallic zipper 64, and an eighth non-metallic zipper 66.

The checkpoint-friendly backpack 10 further comprises a handle 68. The handle 68 is attached to the top wall 36 of the non-dedicated compartment 22.

The checkpoint-friendly backpack 10 further comprises a pair of shoulder straps 70. The pair of shoulder straps 70 extend from the dedicated compartment 20.

C. The Impressions.

It will be understood that each of the elements described above or two or more together may also find a useful application in other types of constructions differing from the types described above.

While the embodiments of the present invention have been illustrated and described as embodied in a checkpoint-friendly backpack, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A checkpoint-friendly backpack for allowing a laptop computer to be stored therein when X-ray screened at an inspection station, without having to remove the laptop computer therefrom, the backpack comprising:

a dedicated compartment for storing the laptop computer, the dedicated compartment consisting of a single closeable pocket in which only a laptop computer may be stored, devoid of any additional pockets or pouches thereon, the dedicated compartment defined by an exterior wall, an interior wall, and four sidewalls, the four sidewalls comprising a top wall, a bottom wall, and two lateral walls, the exterior wall and the interior wall devoid of handles, openings, and zippers, the four sidewalls devoid of straps and buckles;

a non-dedicated compartment comprising a plurality of pockets or pouches for storing removable articles, the non-dedicated compartment defined by an exterior wall, an interior wall, and four sidewalls, the interior wall of the non-dedicated compartment devoid of any pockets or pouches thereon;

wherein a common edge between one of the sidewalls of the dedicated portion and one of the sidewalls of the non-dedicated portion form a single living hinge positioned at the bottom of the bag, the dedicated compartment rotatable at least 180 degrees about the hinge in a screening mode, the interior wall of the dedicated compartment disposed flush against the interior wall of the non-dedicated compartment in a non-screening mode and a portion of the sidewalls of the dedicated compartment being partially disposed within the sidewalls of non-dedicated compartment;

a first non-metallic zipper for accessing the dedicated compartment, the non-metallic zipper disposed continuously on the top wall and along a portion of the two lateral walls of the dedicated compartment, whereby when the backpack is in the non-screening mode the portion of the sidewalls of the dedicated compartment and the first non-metallic zipper are partially disposed within the sidewalls of the non-dedicated compartment so that the portion of the sidewalls and the first non-metallic zipper are not exposed and when the backpack is in the screening mode the portion of the sidewalls and the first non-metallic zipper are exposed; and a second non-metallic zipper to facilitate unfastening the dedicated compartment from the non-dedicated compartment.

2. The backpack of claim 1, wherein the non-dedicated compartment is accessible for the items other than the laptop computer via another non-metallic zipper.

3. The backpack of claim 2, wherein the another non-metallic zipper is disposed continuously on at least three of the sidewalls of said non-dedicated compartment.

4. The backpack of claim 1, wherein the non-dedicated compartment comprises a pair of expandable side pockets.

5. The backpack of claim 4, wherein the pair of expandable side pockets are disposed on at least one of the sidewalls of the non-dedicated compartment, at lower portions thereof, respectively, for storing the items other than the laptop computer.

6. The backpack of claim 4, wherein the pair of expandable side pockets are accessible via a non-metallic zipper and another non-metallic zipper, respectively.

7. The backpack of claim 1, wherein the exterior wall of the non-dedicated compartment harbors an expandable pocket on an upper portion thereof.

8. The backpack of claim 1, wherein the exterior wall of the non-dedicated compartment harbors an expandable pocket on an intermediate portion thereof.

9. The backpack of claim 1, wherein the exterior wall of the non-dedicated compartment harbors an expandable pocket on a lower portion thereof.

10. The backpack of claim 7, wherein the expandable pocket on the upper portion of the exterior wall of the non-dedicated compartment is accessible for the items other than the laptop computer via another non-metallic zipper.

11. The backpack of claim 8, wherein the expandable pocket on said intermediate portion of the exterior wall of the non-dedicated compartment is accessible for the items other than the laptop computer via another non-metallic zipper.

12. The backpack of claim 9, wherein the expandable pocket on said lower portion of the exterior wall of the non-dedicated compartment is accessible for the items other than the laptop computer via another non-metallic zipper.

13. The backpack of claim 1, further comprising a handle attached to a top wall of the sidewalls of the non-dedicated compartment.

14. The backpack of claim 1, further comprising a pair of shoulder straps extending from the dedicated compartment.

15. A checkpoint-friendly backpack for allowing a laptop computer to be stored therein when X-ray screened at an inspection station, without having to remove the laptop computer therefrom, the backpack consisting of:

a dedicated compartment for storing the laptop computer, the dedicated compartment consisting of a single closeable pocket in which only a laptop computer may be stored, devoid of any additional pockets or pouches thereon, the dedicated compartment defined by an exterior wall and an interior wall and four sidewalls, the exterior wall and the interior wall devoid of handles, openings, and zippers, the four sidewalls devoid of straps and buckles;

a non-dedicated compartment comprising a plurality of pockets or pouches for storing removable articles, the non-dedicated compartment defined by an exterior wall and an interior wall and four sidewalls, the interior wall of the non-dedicated compartment devoid of any pockets or pouches thereon;

a handle being attached to a top wall of the sidewalls of the non-dedicated compartment;

a pair of shoulder straps extending from the dedicated compartment;

wherein a common edge between one of the sidewalls of the dedicated portion and one of the sidewalls of the non-dedicated portion form a single living hinge positioned at the bottom of the bag, the dedicated compartment rotatable at least 180 degrees about the hinge in a screening mode, the interior wall of the dedicated compartment disposed flush against the interior wall of the non-dedicated compartment in a non-screening mode and a portion of the side walls of the dedicated compartment being partially disposed within the side walls of non-dedicated compartment;

a first non-metallic zipper for accessing the dedicated compartment, the non-metallic zipper disposed continuously on the top wall and along a portion of the two lateral walls of the dedicated compartment, whereby when the backpack is in the non-screening mode the portion of the sidewalls of the dedicated compartment and the first non-metallic zipper are partially disposed within the sidewalls of the non-dedicated compartment so that the portion of the sidewalls and the first non-metallic zipper are not exposed and when the backpack is in the screening mode the portion of the sidewalls and the first non-metallic zipper are exposed; and a second non-metallic zipper to facilitate unfastening the dedicated compartment from the non-dedicated compartment.

16. The backpack of claim 15, wherein the non-dedicated compartment is accessible for the items other than the laptop computer via another non-metallic zipper.

17. The backpack of claim 16, wherein the another non-metallic zipper is disposed continuously on at least three of the sidewalls of said non-dedicated compartment.

18. The backpack of claim 15, wherein the non-dedicated compartment comprises a pair of expandable side pockets.

19. The backpack of claim 18, wherein the pair of expandable side pockets are disposed on at least one of the sidewalls of the non-dedicated compartment, at lower portions thereof, respectively, for storing the items other than the laptop computer.

20. The backpack of claim 18, wherein the pair of expandable side pockets are accessible via a non-metallic zipper and another non-metallic zipper, respectively.

21. The backpack of claim 15, wherein the exterior wall of the non-dedicated compartment harbors an expandable pocket on an upper portion thereof.

22. The backpack of claim 15, wherein the exterior wall of the non-dedicated compartment harbors an expandable pocket on an intermediate portion thereof.

23. The backpack of claim 15, wherein the exterior wall of the non-dedicated compartment harbors an expandable pocket on a lower portion thereof.

24. The backpack of claim 21, wherein the expandable pocket on the upper portion of the exterior wall of the non-dedicated compartment is accessible for the items other than the laptop computer via another non-metallic zipper.

25. The backpack of claim 22, wherein the expandable pocket on said intermediate portion of the exterior wall of the non-dedicated compartment is accessible for the items other than the laptop computer via another non-metallic zipper.

26. The backpack of claim 23, wherein the expandable pocket on said lower portion of the exterior wall of the non-dedicated compartment is accessible for the items other than the laptop computer via another non-metallic zipper.

27. The backpack of claim 15, further comprising a handle attached to a top wall of the sidewalls of the non-dedicated compartment.

28. The backpack of claim 15, further comprising a pair of shoulder straps extending from the dedicated compartment.

* * * * *